United States Patent [19]

Cleland

[11] 4,389,308

[45] Jun. 21, 1983

[54] APPARATUS FOR SEPARATING ORES

[76] Inventor: Keith B. Cleland, 4460 Park Newport, Newport Beach, Calif. 92660

[21] Appl. No.: 322,906

[22] Filed: Nov. 19, 1981

[51] Int. Cl.[3] ..... B03B 5/58

[52] U.S. Cl. ..... 209/444; 209/452; 474/196

[58] Field of Search ..... 209/444, 452, 506, 260, 209/434, 436, 445, 451; 474/196, 902, 903

[56] References Cited

U.S. PATENT DOCUMENTS

| | | | |
|---|---|---|---|
| 658,947 | 10/1900 | Goyne et al. . | |
| 825,982 | 7/1906 | Romunder | 474/196 |
| 987,866 | 3/1911 | Earle | 209/452 |
| 1,636,492 | 7/1927 | Taylor | 474/902 |
| 1,853,249 | 4/1932 | Ainlay . | |
| 1,986,778 | 1/1935 | Hinkley | 209/452 |
| 2,064,554 | 12/1936 | Mahoney et al. | 209/452 |
| 2,155,587 | 4/1939 | Fairbank | 209/451 |
| 2,312,760 | 3/1943 | Heidegger | 474/903 |
| 2,608,299 | 8/1952 | Huelsdonk | 209/452 |
| 2,701,971 | 2/1955 | Carter et al. | 474/902 |
| 4,008,152 | 2/1977 | Kleven | 209/444 |
| 4,110,206 | 8/1978 | Kleven | 209/43 |
| 4,267,036 | 5/1981 | Kleven | 209/444 |

FOREIGN PATENT DOCUMENTS

| | | | |
|---|---|---|---|
| 846154 | 8/1960 | United Kingdom | 209/451 |

OTHER PUBLICATIONS

Exhibits A and B: 2 page flyer entitled "Simple Portable Affordable Automatic Panning".

Exhibit C: 1 page flyer entitled "Goldhound", 4078 Lincoln Blvd., Marina Del Rey, CA 90291, Cpr. 1980.

*Primary Examiner*—Tim R. Miles

*Attorney, Agent, or Firm*—William W. Haefliger

[57] ABSTRACT

An ore separation device is described in which a bowl-shaped separator is equipped with a drive shaft and mounted on a table for rotation of the separator. The drive shaft is secured to the interior of the hub of the separator by a spider or series of ribs, and the hub includes an interior rigid cylindrical member and an exterior flexible cylindrical member attached to the bottom of the separator.

12 Claims, 4 Drawing Figures

APPARATUS FOR SEPARATING ORES

BACKGROUND OF THE INVENTION

In ore concentrators of the type shown in U.S. Pat. No. 1,986,778 to Hinkley, the number of leads employed on the rotating bowl was between about five and ten, so that the size of the center hole to which material is led was minimal. Accordingly, hollow bowl rotating shafts could be used to conduct the material from the center hole and away from the bowl.

However, when the size of the machine increased significantly, the number of leads in the bowl increased to between 60 and 100, for example. As a consequence, the size of the central opening and of the hollow shaft increased markedly, and to the point where undesirably large shaft bearings and associated apparatus would be required.

SUMMARY OF THE INVENTION

The present invention allows solid rotating shafts for the bowls, characterized by their design for the structural integrity of the system versus a transporting characteristic for concentrates. Accordingly, the need for large size hollow shafts is eliminated.

DETAILED DESCRIPTION OF THE INVENTION

Figure 4:
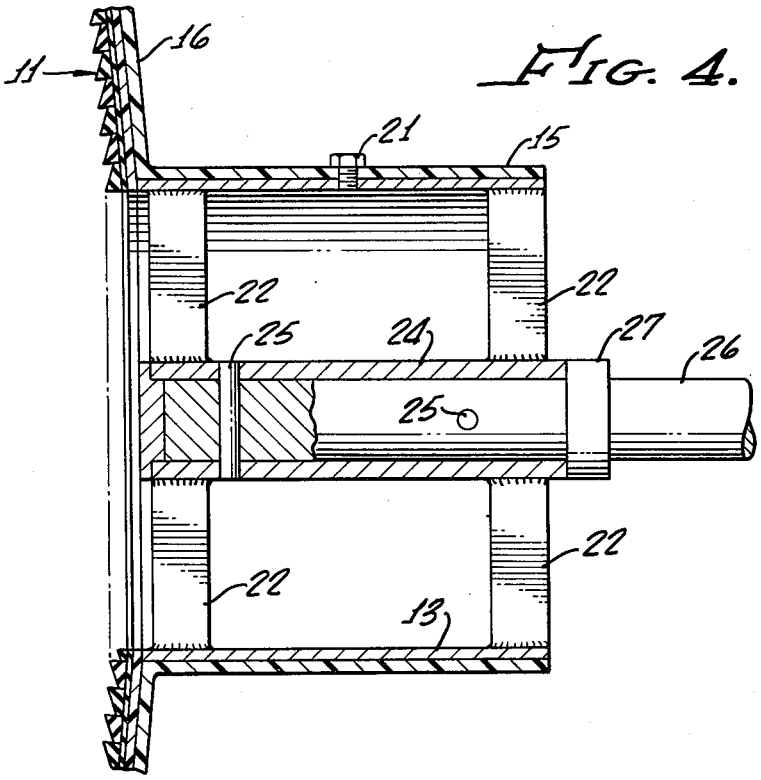
FIG. 4 is a cross-sectional view of the assembled hub, drive shaft, and a portion of the bowl.

The ore separation apparatus includes a rotatable bowl 10 having an inner liner 11 of spiral grooves or riffles and a central outlet or opening 12 for discharging concentrated values of the ore. The apparatus includes cylindrical hub 14 at the periphery of the central opening 12. The hub includes an inner cylinder 13 and an outer cylinder 15 which is integrally connected with a dish-shaped portion 16, the latter being connected at its periphery to frustoconical flange 18 which terminates at outwardly flaring lip 20. Inner cylinder 13 of the hub is comprised of a rigid material, such as steel, to lend structural strength and rigidity to the hub, while outer cylinder 15 is comprised of fiberglass as is the dish-shaped portion 16 of the bowl. The inner cylinder 13 is sized to fit snugly within the outer cylinder, and the two are locked together against rotational or longitudinal slippage by means of set screw 21, as shown in FIG. 4.

Figure 2:
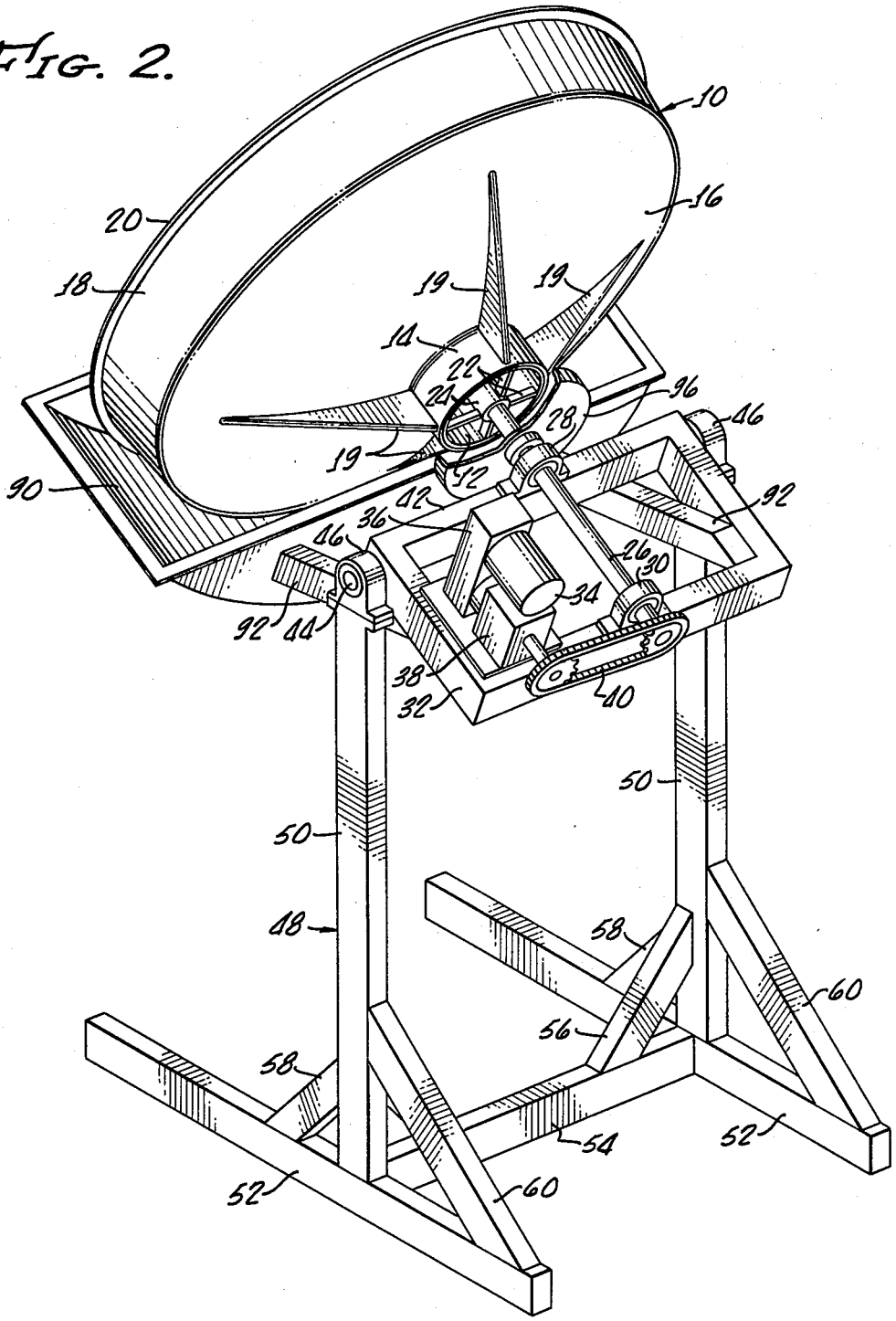
FIG. 2 shows a rear perspective view of the apparatus.
Figure 3:
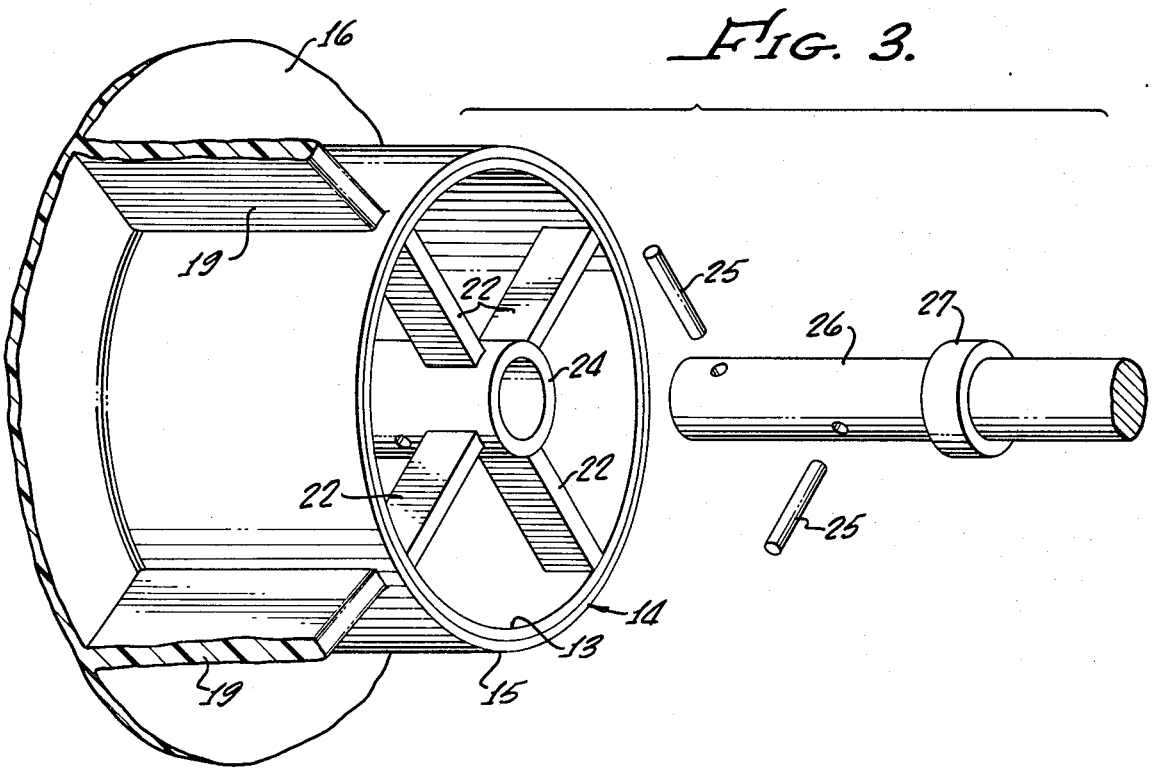
FIG. 3 is an exploded fragmentary perspective of the hub and drive shaft.

A series of radially extending stiffening ribs, also comprised of fiberglass, are integrally formed and joined with the outer surfaces of outer cylinder 15 and dish-shaped portion 16 of the bowl 10, as shown in FIG. 2. These ribs serve the dual function of strengthening both the bowl and the hub against both torsional and lateral deformation when heavy loads of ore are in the bowl.

A spider means or series of ribs 22 are provided to connect the interior of hub 14 with a central mounting sleeve 24, which is pinned to drive shaft 26 by means of pins 25. Preferably, two sets of ribs 22 radiate outwardly from mounting sleeve 24 at longitudinally spaced apart positions, as shown in FIG. 4. Preferably, at least three ribs, and, more preferably, at least four ribs, are provided near each end of hub 14. By constructing the inner cylinder 13, the ribs 22, and the central mounting sleeve 24 of a strong, rigid material, such as steel, and unitizing these components, e.g., by welding, an exceptionally durable and advantageous hub arrangement can be achieved.

The drive shaft 26 is positioned within sleeve 24 a predetermined distance by means of collar 27, and is rotatably mounted by means of forward bearing 28 and rear bearing 30 on table 32. Table 32 also supports a drive motor 34, transmission means 36, gear box 38, and gear means 40 for rotating drive shaft 26 and bowl 10 in a clockwise direction, as viewed in FIG. 1.

The table 32 is equipped along its forward portion 42 with transverse axles or journals 44 for pivotally mounting the table in bearings 46. The bearings 46 are mounted upon table support 48 which is comprised of a pair of vertical stanchions 50 and longitudinal runners 52, which are connected by transverse member 54 and braced by transverse braces 56, forward braces 58, and rear braces 60.

The axis of rotation of bowl 10 is generally at a low acute angle to the horizontal, but it may be controlled and varied between a substantially horizontal position and a position approaching the vertical by means, e.g., of a hydraulic control system, as described and claimed in my co-pending application Ser. No. 322,905, Apparatus for Separating Ores, filed on even date herewith, which is incorporated herein by reference.

Figure 1:
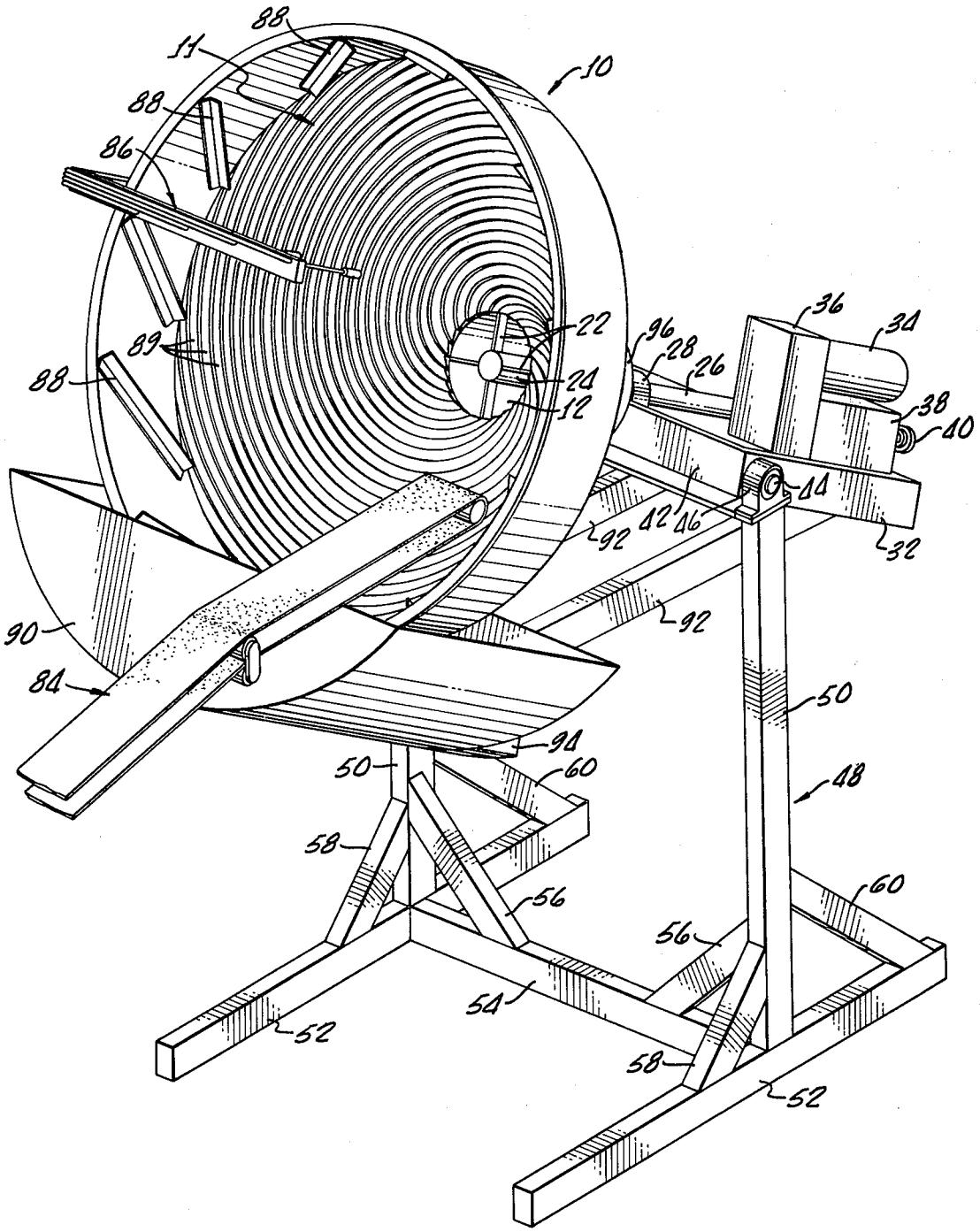
FIG. 1 shows a front perspective view of ore separation apparatus in accordance with the present invention.

When the apparatus of the invention is used for separating ore, the drive shaft 26 is rotated by motor 34 to turn the bowl 10 in a clockwise direction, as viewed in FIG. 1. Crude ore is fed into the bowl by conveyor 84 and lubricated using water spray means 86. The bowl is equipped with mixing vanes 88 which aid in the distribution and mixing of the ore and water. As the bowl rotates, heavy ore values migrate through spiral grooves 89 to the central opening 12 of the bowl. The spiral grooves 89 (constructed, for example, of rubber) are formed as a part of liner 11, which is secured to the inside of the dish-shaped portion 16 of the bowl.

Waste material or gangue is discharged at the lower periphery of the bowl into trough 90, which is mounted on support members 92. The support members 92 are connected rigidly to table 42 to pivot therewith.

Waste material from the trough 90 is discharged continuously through trough outlet 94 where it may be disposed of (by means not shown). The concentrated ore which leaves the bowl through central opening 12 is received or controlled by concentrated ore receptacle 96 from which it is discharged downwardly and caught in containers or receptacles (not shown).

When large loads of ore are fed into the apparatus, very high bending stresses are imposed upon both the bowl and the hub, especially when the axis of rotation of the bowl and hub is maintained at a desirable acute angle to the horizontal. This is aggravated further when very large containers are used, such as those seven or more feet in diameter. By employing at least three, and, preferably, four or more, stiffening ribs 19 radiating outwardly from the outer fiberglass cylinder 15 of the hub 14 and along a major portion of the radius of the bowl-shaped container, excessive deformation of the bowl is prevented. At the same time, tearing or bending of the outer cylinder 15 of the hub is prevented by the stiffening effect of ribs 19, together with the backing provided internally by the rigid cylinder 13. The series of spokes 22 enable the hub and container to maintain their predetermined axial alignment with drive shaft 26, even under severe load conditions. By employing the novel arrangement of the invention, it is unnecessary to provide other devices, such as external rollers beneath the container, to help support it. This greatly simplifies the overall construction of the apparatus, since the use of such devices as supporting rollers would require means not only for mounting the rollers, but also means to maintain them in contact with the lower portions of the container at varying angles of tilt of the axis of rotation.

Many other uses and variations of the invention will be apparent to those skilled in the art, and while specific embodiments of this invention have been described, these are intended for illustrative purposes only. It is intended that the scope of the invention by limited only by the attached claims.

What is claimed is:

1. Ore separation apparatus comprising a rotatable container having a concave portion with an opening for discharging concentrated ore at its center, an elongated cylindrical hub, one end of which abuts said container and circumscribes said opening to pass said concentrated ore, the hub mounting the container, drive means including an elongated drive shaft substantially smaller in cross section than said opening, said drive shaft having one end portion centered within said hub and extending outwardly therefrom away from the container, and spider means connecting the shaft to the interior of said hub, whereby the hub is mounted to the shaft so that the entire weight of the container is transmitted via the hub to the shaft end portion, said concave portion of said container facing away from said hub, and said shaft being axially aligned therewith.

2. The invention recited in claim 1 wherein said hub comprises an outer cylinder unitarily attached to said concave portion of the container, a rigid inner cylinder compatibly sized to fit snugly within said outer cylinder, and means for securing said inner and outer cylinders against relative rotational or longitudinal movement therebetween, the container having a spiral grooved liner received therein and free of direct connection to the shaft.

3. The invention recited in claim 2 wherein said spider means includes a plurality of rigid ribs extending radially outwardly from said drive shaft to said inner cylinder, fixing said shaft in spaced apart relationship to the wall of said inner cylinder and substantially centered therewithin, said ribs being sized to permit substantially unrestricted flow of said concentrated ore out of said container through the annular space between the drive shaft and the inner cylinder.

4. The invention recited in claim 3 wherein said concave portion of said container and said outer cylinder are comprised of fiberglass.

5. The invention recited in claim 4 wherein said spider means is comprised of steel.

6. The invention recited in claim 4 further comprising a series of elongated fiberglass stiffening ribs, and stiffening ribs extending radially outwardly from the outer surface of said outer cylinder and along the outer surface of said container and being joined with both the outer cylinder and the container to substantially strengthen said cylinder and container to minimize deformation thereof when said apparatus is loaded with ore.

7. The invention recited in claim 4 wherein said spider means includes two sets of said radially extending ribs, said sets being spaced apart axially of the shaft, the ribs of each set spaced about said drive shaft within said hub.

8. The invention recited in claim 7 wherein each of said sets comprises at least three radially extending ribs.

9. The invention recited in claim 8 further comprising a series of fiberglass stiffening ribs, said stiffening ribs extending radially outwardly from the outer surface of said outer cylinder and along the outer surface of said container, said stiffening ribs being unitarily joined with both the outer cylinder and the container to stiffen and minimize deformation thereof when said apparatus is loaded with ore.

10. The invention as defined in claim 1 including an inner hub removably receiving said one end portion of the shaft, and to which said spider means is connected.

11. The invention as defined in claim 10 wherein the shaft has a collar providing a support for the end of the inner hub, thereby to position the container.

12. The invention as defined as claim 11 including shear pins interconnecting the inner hub and the shaft.

* * * * *